US012150569B1

(12) United States Patent
Leach

(10) Patent No.: US 12,150,569 B1
(45) Date of Patent: Nov. 26, 2024

(54) COLLAPSIBLE HEADWEAR STORAGE ASSEMBLY

(71) Applicant: Christopher Leach, Laramie, WY (US)

(72) Inventor: Christopher Leach, Laramie, WY (US)

( * ) Notice: Subject to any disclaimer, the term of this patent is extended or adjusted under 35 U.S.C. 154(b) by 0 days.

(21) Appl. No.: 18/382,484

(22) Filed: Oct. 21, 2023

(51) Int. Cl.
*A47F 7/06* (2006.01)
*A47F 5/05* (2006.01)
*A47F 5/06* (2006.01)

(52) U.S. Cl.
CPC ..... *A47F 7/06* (2013.01); *A47F 5/05* (2013.01); *A47F 5/06* (2013.01)

(58) Field of Classification Search
CPC ..... A47F 7/06; A47F 5/05; A47F 5/06; A47F 7/065; A47F 5/04; D06F 57/04; A47B 61/04; A47G 25/10
USPC ..... 211/33, 1.3, 196, 205
See application file for complete search history.

(56) References Cited

U.S. PATENT DOCUMENTS 1,276,300 A * 8/1918 Wideen ..... A47F 5/06 211/172
1,599,616 A * 9/1926 Hamburger ..... A47F 5/06 211/208
1,729,395 A * 9/1929 Mandel ..... A47G 25/0664 33/8
1,746,487 A * 2/1930 Martin ..... A47G 25/10 33/8
1,748,597 A * 2/1930 Collins ..... A47G 25/0664 248/407
1,973,521 A * 9/1934 Bullard ..... A47G 25/0664 248/161
3,281,102 A * 10/1966 Hobson ..... A47F 5/04 248/220.31
3,515,318 A * 6/1970 Preble ..... A45D 44/14 223/66
3,698,779 A * 10/1972 Holmes ..... A47F 5/06 312/305
3,779,433 A * 12/1973 Imai ..... A45D 44/14 223/66
D230,777 S * 3/1974 Imai et al. ..... D28/93
5,002,190 A 3/1991 Moreland
5,566,837 A 10/1996 Lema
5,715,955 A * 2/1998 Hannecke ..... A47F 5/05 211/205
6,123,238 A 9/2000 Dumplet
6,371,686 B1 * 4/2002 Wu ..... F16B 7/105 135/25.1

(Continued)

FOREIGN PATENT DOCUMENTS

CA 2143775 9/1995

*Primary Examiner* — Jennifer E. Novosad

(57) ABSTRACT

A collapsible headwear storage assembly includes a base that is positionable on a horizontal support surface. A pole is coupled to and extends upwardly from the base such that the pole is vertically oriented when the base is positioned on the horizontal support surface. A plurality of cups is provided and each of the plurality of cups is slidably disposed on the pole. The plurality of cups is arrangeable into a deployed position having the plurality of cups being distributed along a substantial length of the upper half of the pole. A plurality of holding units and each of the plurality of holding units is removably attachable to a respective one of the plurality of cups when the plurality of cups is positioned in the deployed position to support an article of headwear.

12 Claims, 7 Drawing Sheets

(56) References Cited

U.S. PATENT DOCUMENTS

| | | | | |
|---|---|---|---|---|
| 6,595,377 | B1 * | 7/2003 | Hetu | A47F 7/0078 211/208 |
| 6,915,930 | B2 | 7/2005 | Dixon | |
| 7,040,517 | B1 | 5/2006 | Swanson | |
| D669,940 | S * | 10/2012 | Berkshire | D21/471 |
| 8,662,324 | B2 * | 3/2014 | Robinson | A61J 9/0684 211/126.5 |
| D719,769 | S | 12/2014 | Daniels | |
| 8,950,591 | B1 * | 2/2015 | McDowell | A45D 44/14 211/13.1 |
| 9,427,066 | B2 * | 8/2016 | Davidson | A45D 44/14 |
| 9,538,831 | B1 * | 1/2017 | Tracy | D06F 57/04 |
| 9,867,461 | B1 * | 1/2018 | Smith | F16B 7/105 |
| 10,219,605 | B1 * | 3/2019 | Love | A47F 5/06 |
| 11,046,380 | B1 * | 6/2021 | Gu | B62H 3/12 |
| 11,122,916 | B2 * | 9/2021 | Gregory | F16B 12/22 |
| 2009/0071922 | A1 * | 3/2009 | Barra | F16M 11/046 211/85.3 |
| 2012/0074181 | A1 | 3/2012 | Reid | |
| 2016/0262560 | A1 * | 9/2016 | Fields | A47F 7/065 |
| 2019/0070472 | A1 * | 3/2019 | Duran | A47F 5/04 |

* cited by examiner

COLLAPSIBLE HEADWEAR STORAGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to headwear storage devices and more particularly pertains to a new headwear storage device for storing a plurality of articles of headwear. The device includes a pole with a telescopically adjustable height and a plurality of cups slidably disposed on the pole which are can be deployed along the pole or nested within each other while collapsed. The device includes a plurality of holding units that are each releasably attachable to a respective cup which each includes an arm that engages the respective cup and a plate for holding an article of headwear.

(2) Description of Related Art Including Information Disclosed Under 37 CFR 1.97 and 1.98

The prior art relates to headwear storage devices including a variety of hat hanger devices that each at least includes a central member and a plurality of hangers that are each attached to and distributed along the central member which can each suspend a hat from the central member for storage. In no instance does the prior art disclose a collapsible hat hanger that includes a telescopic pole and a plurality of nestable cups that are slidably disposed on the telescopic pole and a plurality of holding units that are each releasably attachable to a respective one of the nestable cups for holding a hat.

BRIEF SUMMARY OF THE INVENTION

An embodiment of the disclosure meets the needs presented above by generally comprising a base that is positionable on a horizontal support surface. A pole is coupled to and extends upwardly from the base such that the pole is vertically oriented when the base is positioned on the horizontal support surface. A plurality of cups is provided and each of the plurality of cups is slidably disposed on the pole. The plurality of cups is arrangeable into a deployed position having the plurality of cups being distributed along a substantial length of the upper half of the pole. A plurality of holding units is provided and each of the plurality of holding units is removably attachable to a respective one of the plurality of cups when the plurality of cups is positioned in the deployed position to support an article of headwear.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
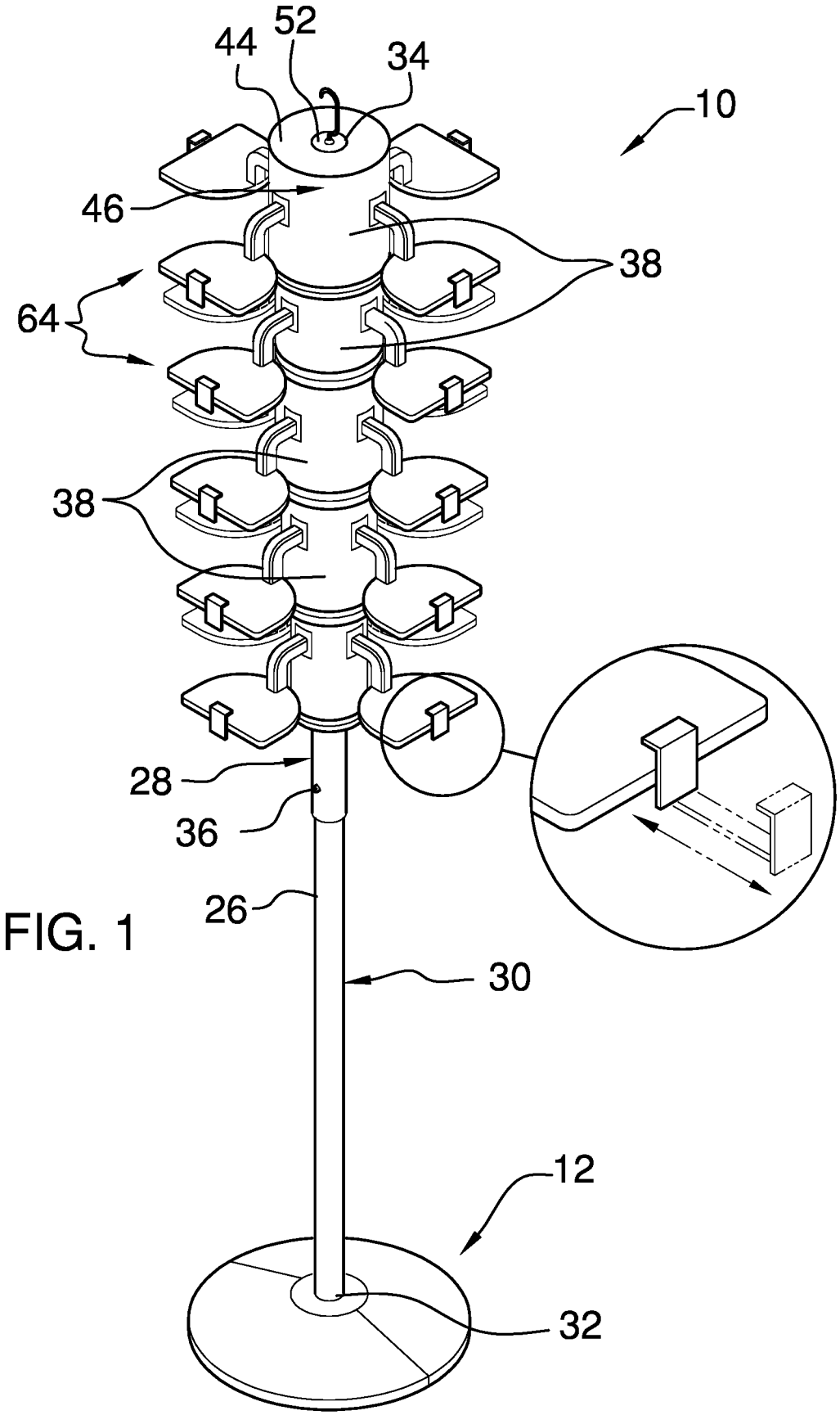
FIG. 1 is a top perspective view of a collapsible headwear storage assembly according to an embodiment of the disclosure.
Figure 2:
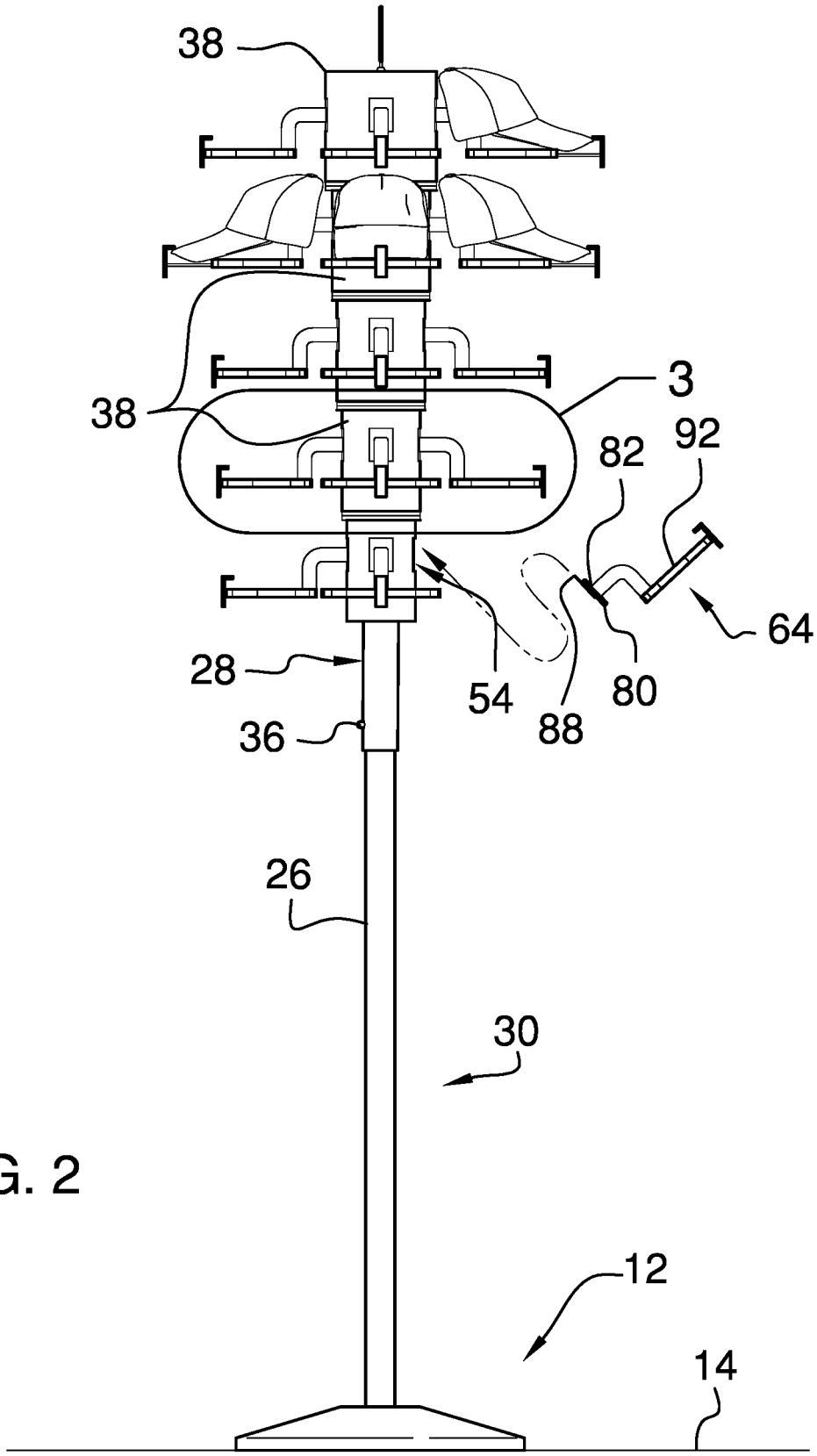
FIG. 2 is a front view of an embodiment of the disclosure.
Figure 3:
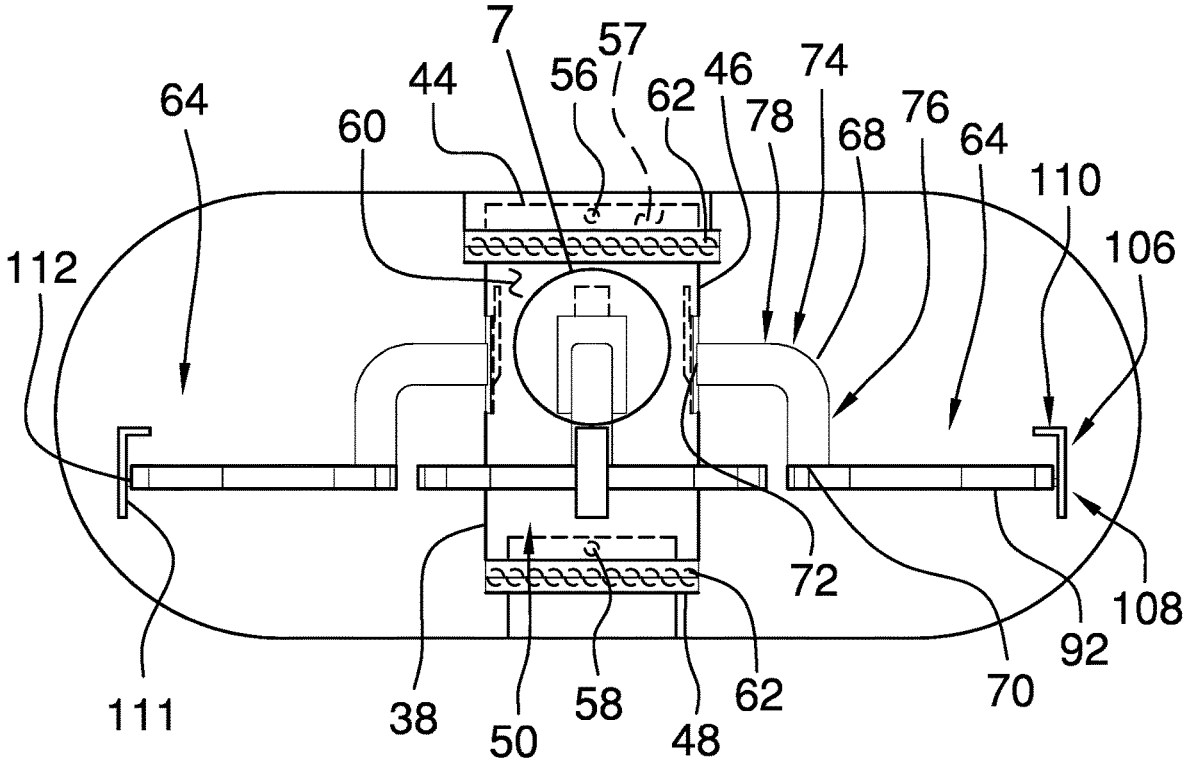
FIG. 3 is a magnified phantom view taken from circle 3 of FIG. 2 of an embodiment of the disclosure.
Figure 4:
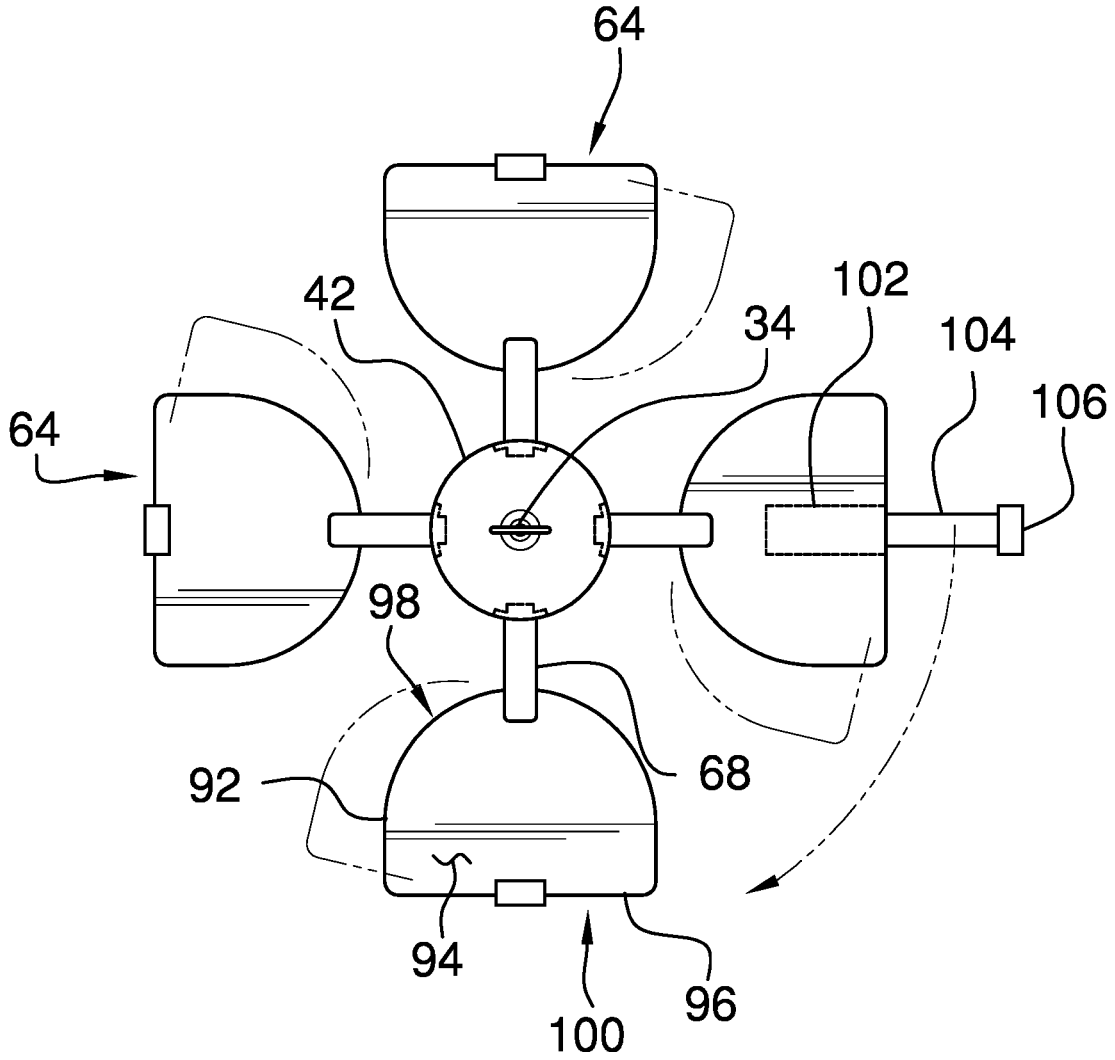
FIG. 4 is a top view of an embodiment of the disclosure.
Figure 5:
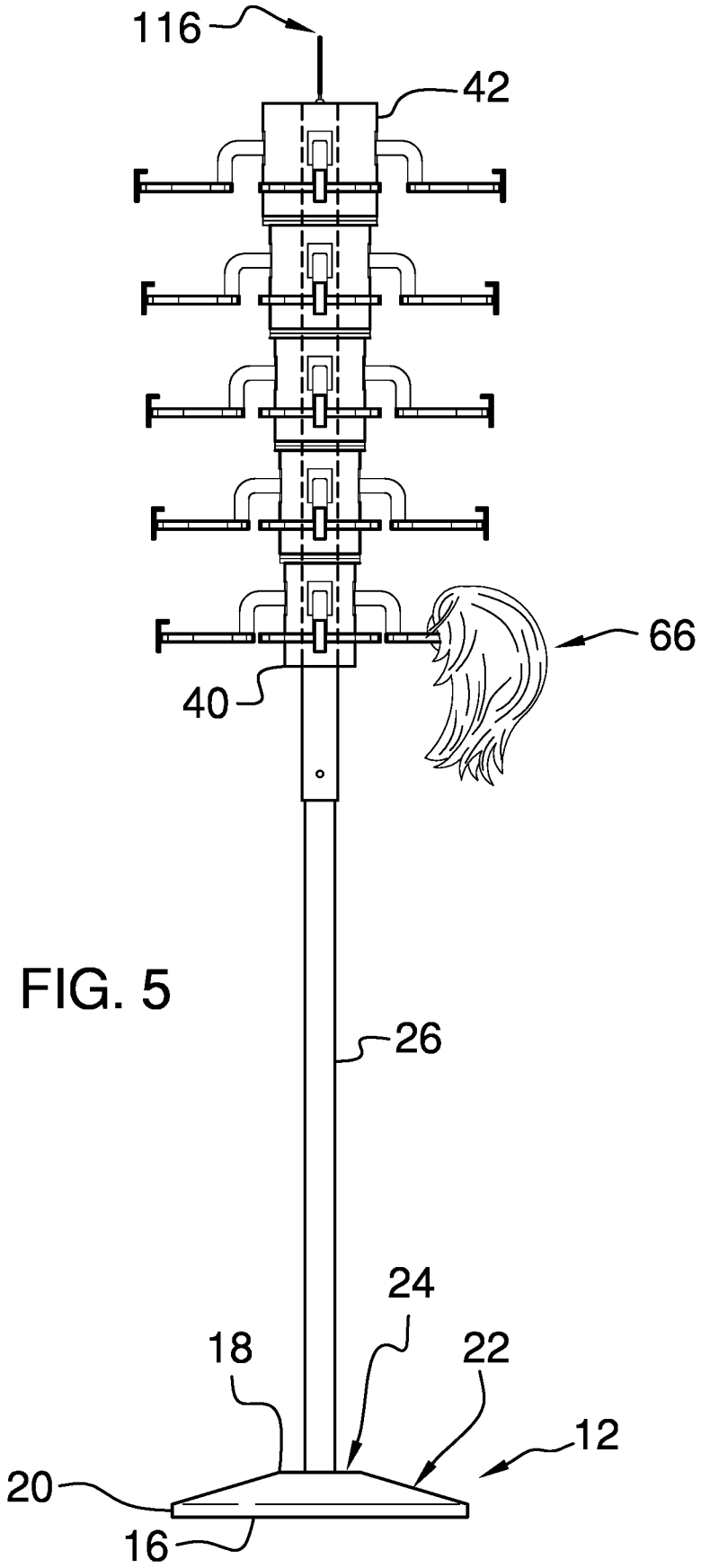
FIG. 5 is a perspective in-use view of an embodiment of the disclosure.
Figure 6:
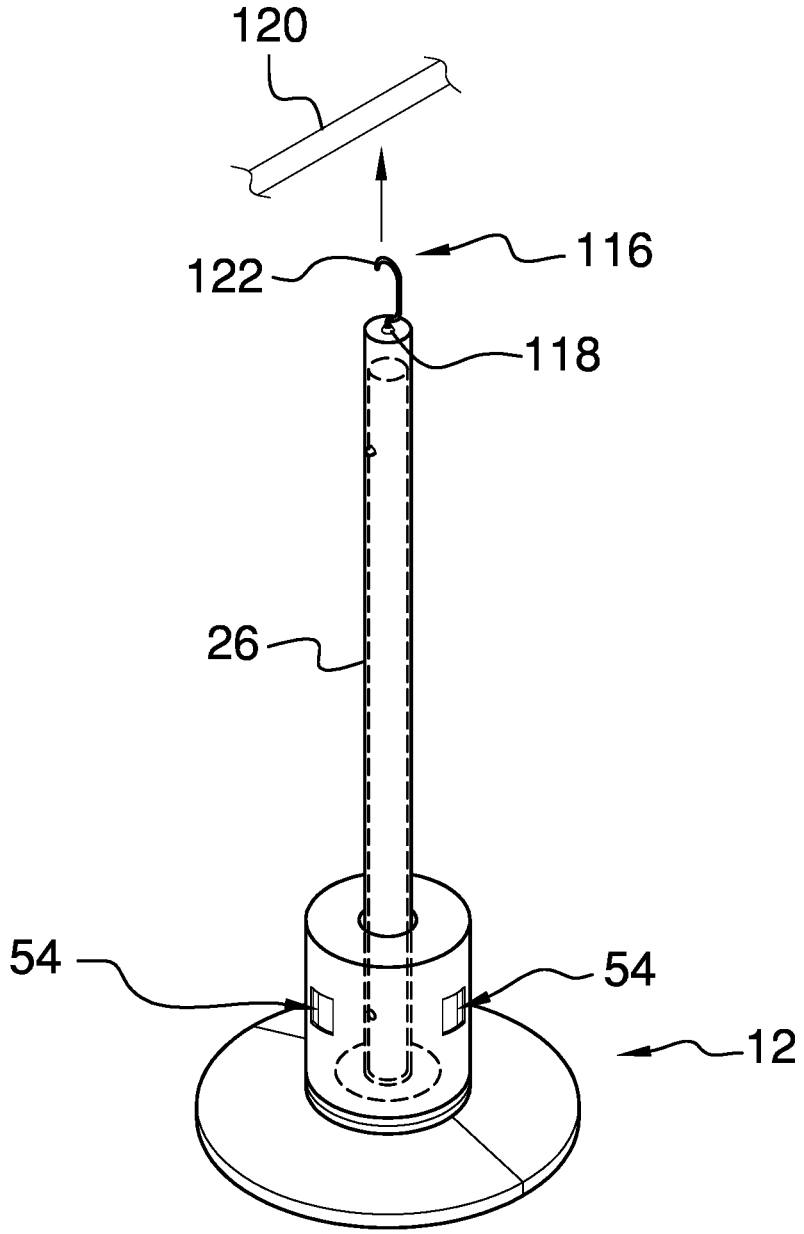
FIG. 6 is a perspective in-use view of an embodiment of the disclosure showing a pole being collapsed and a plurality of cups being nested within each other.
Figure 7:
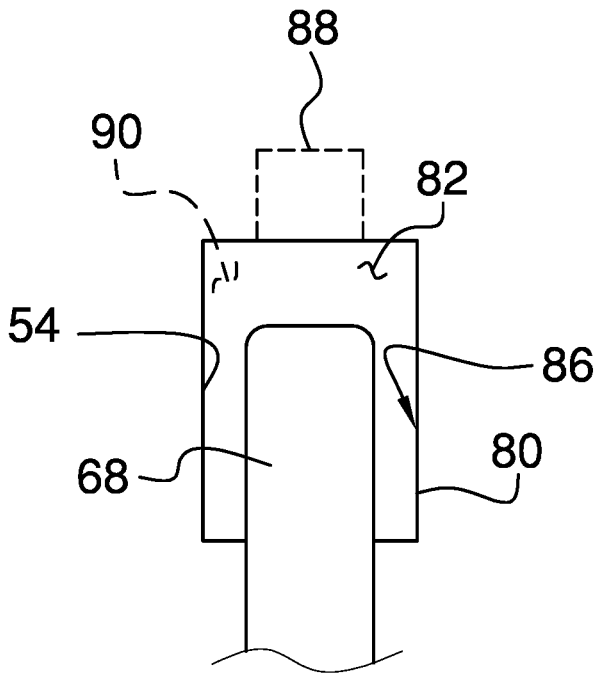
FIG. 7 is a magnified detail view taken from circle 7 of FIG. 3 of an embodiment of the disclosure.

With reference now to the drawings, and in particular to FIGS. 1 through 7 thereof, a new headwear storage device embodying the principles and concepts of an embodiment of the disclosure and generally designated by the reference numeral 10 will be described.

As best illustrated in FIGS. 1 through 7, the collapsible headwear storage assembly 10 generally comprises a base 12 that is positionable on a horizontal support surface 14 such as a floor of a building or the like. The base 12 has a bottom side 16, a top side 18 and a perimeter edge 20 extending between the top side 18 and the bottom side 16 and the perimeter edge 20 is continuously arcuate about a center of the base 12 such that the base 12 has a circular shape. The top side 18 has an angled portion 22 which slopes upwardly from the perimeter edge 20 and a planar portion 24 that is oriented parallel to the bottom side 16; the planar portion 24 is centrally located has the angled portion 22 surrounding the planar portion 24.

A pole 26 is coupled to and extends upwardly from the base 12 such that the pole 26 is vertically oriented when the base 12 is positioned on the horizontal support surface 14. The pole 26 comprises an upper half 28 with slidably receives a lower half 30 such that the pole 26 has a telescopically adjustable length. The pole 26 has a bottom end 32 that is coupled to the top side 18 of planar portion 24 of the top side 18 of the base 12; the bottom end 32 is associated with the lower half 30 and the pole 26 has a top end 34 that is associated with the upper half 28. The pole 26 includes a lock 36 that is movably integrated into the lower half 30 and the lock 36 releasably engages the upper half 28 when the upper half 28 is urged into an extended position for retaining the pole 26 at a maximum length. Conversely, the lock 36 is urgeable to disengage the upper half 28 to facilitate the upper half 28 to be lowered onto the lower half 30 for positioning the pole 26 at a minimum length for storage.

A plurality of cups 38 is provided and each of the plurality of cups 38 is slidably disposed on the upper half 28 of the pole 26. Each of the plurality of cups 38 has an incrementally increasing diameter between a bottom one of the plurality of cups 40 and a top one of the plurality of cups 42. The cups 38 are arrangeable into a deployed position having the plurality of cups 38 being distributed along a substantial length of the upper half 28 of the pole 26. The cups 38 are arrangeable into a collapsed position having each of the plurality of cups 38 is stored within the top cup 42. Each of the plurality of cups 38 has an upper wall 44 and an outer wall 46 extending downwardly from the upper wall 44 and the outer wall 46 of each of the plurality of cups 38 has a lower edge 48 defining an opening 50 into a respective cup 38.

The upper wall 44 of each of the plurality of cups 38 has a hole 52 extending through the upper wall 44 having the upper half 28 of the pole 26 extending through the hole 52 in the upper wall 44 of each of the plurality of cups 38. Each of the plurality of cups 38 has a plurality of engagement holes 54 each extending through the outer wall 46. The plurality of engagement holes 54 in the outer wall 46 are evenly spaced apart from each other and are distributed around a full circumference of the outer wall 46. Each of the plurality of engagement holes 54 is positioned closer to the upper wall 44 than the lower edge 48 of the outer wall 46. Each of the plurality of cups 38 may have a detent 56 that is recessed into an interior surface 57 of the outer wall 46 and the detent 56 may be positioned closer to the lower edge 48 of the outer wall 46 than the upper wall 44. Each of the plurality of cups 38 may have a knob 58 extending away from an outer surface 60 of the outer wall 46. The knob 58 on the outer wall 46 of each of the plurality of cups 38 may engage the detent 56 in an adjacent one of the plurality of cups 38 when the plurality of cups 38 is arranged in the deployed position for releasably retaining the plurality of cups 38 in the deployed position.

A plurality of bearings 62 is provided and each of the plurality of bearings 62 is attached to the interior surface 57 of the outer wall 46 of a respective one of the plurality of cups 38. Each of the plurality bearings 62 is continuously arcuate such that each of the plurality of bearings 62 forms a closed ring thereby facilitating each of the plurality of bearings 62 to conform to curvature of the interior surface 57 of the outer wall 46. Each of the plurality of bearings 62 engages the outer surface 60 of the outer wall 46 of a respective one of the plurality of cups 38 thereby facilitating the plurality of cups 38 to be rotatable about a respective one of the cups 38. Each of the plurality of bearings 62 is aligned with the lower edge 48 of the outer wall 46 of the respective cup. Additionally, each of the bearings 62 may comprise a ball bearing or other type of friction reducing bearing.

A plurality of holding units 64 is provided and each of the plurality of holding units 64 is removably attachable to a respective one of the plurality of cups 38 when the plurality of cups 38 is positioned in the deployed position. In this way each of the plurality of holding units 64 can support an article of headwear 66. The article of headwear 66 may comprise a baseball cap, a wig, a stocking cap or any other article of headwear 66. Each of the holding units 64 comprises an arm 68 that has a first end 70 and a second end 72. The arm 68 has a bend 74 that is centrally located between the first end 70 and the second end 72 to define a first portion 76 of the arm 68 forming an angle with a second portion 78 of the arm 68.

Each of the holding units 64 includes a plate 80 that has a front surface 82 which is attached to the second end 72 of the arm 68. The second end 72 of the arm 68 is insertable into a respective one of the plurality of engagement holes 54 in the outer wall 46 of a respective one of the cups 38 such that the plate 80 fills the respective engagement hole 52 having an exterior edge 84 of the plate 80 conforming to a bounding edge 86 of the respective engagement hole 52. Each of the holding units 64 includes a foot 88 that is coupled to a back surface 90 of the plate 80 such that the foot 88 extends upwardly beyond the plate 80. The foot 88 abuts the interior surface 57 of the outer wall 46 of the respective cup 38 when the second end 72 of the arm 68 is inserted into the respective engagement hole 52. In this way the foot 88 retains the second portion 78 of the arm 68 along a horizontal axis having the first portion 76 of the arm 68 extending downwardly from the second portion 78.

Each of the plurality of holding units 64 includes a panel 92 that has an upper surface 94 and a perimeter edge 96 which has a back side 98 that is concavely arcuate with respect to a front side 100 of the perimeter edge 96 of the panel 92 such that the panel 92 has a semicircular shape. The second end 72 of the arm 68 is coupled to the upper surface 94 of the panel 92 at a point located adjacent to the back side 98. The second end 72 of the arm 68 is centrally located along the back side 98. The panel 92 is oriented to lie on a horizontal plane when the arm 68 is secured in the respective engagement hole 52. In this way the article of headwear 66 can be positioned on top of the upper surface 94. The panel 92 has a slide well 102 extending through the front side 100 of the perimeter edge 96 of the panel 92 into an interior of the panel 92 and the slide well 102 is centrally located along the front side 100.

Each of the plurality of holding units 64 includes a member 104 that is slidably inserted into the slide well 102 in the front side 100 of the perimeter edge 20 of the panel 92. Each of the plurality of holding units 64 includes a grip 106 that has a first section 108 forming an angle with a second section 110. A forward surface 111 of the first section 108 is attached to an exposed end 112 of the member 104 such that the second section 110 of the grip 106 is spaced upwardly from the member 104 and is oriented to lie on a plane that is oriented parallel to the member 104. The member 104 is positionable in a deployed position having the grip 106 being spaced from the front side 100 of the perimeter edge 20 of the panel 92. In this way a brim of the article of headwear 66 can be positioned between the second section 110 and the member 104 for securing the article of headwear 66 on the panel 92. Conversely, the member 104 is positionable in a stored position having the first section 108 lying against the front side 100 of the perimeter edge 20 of the panel 92.

A hook 116 is included which has a lowermost end 118 that is coupled to and extends upwardly from the top end 34 of the pole 26. In this way the hook 116 can be engaged to a support 120 for suspending the pole 26 from the support 120. The support 120 may be a hanger rod in a closet, for example, or other type of generally cylindrical support. The hook 116 has an uppermost end 122 and the hook 116 is curved between the lowermost end 118 and the uppermost end 122 such that the uppermost end 122 is directed downwardly toward the lowermost end 118. Light emitters could potentially be integrated into the plurality of cups 38 for illuminating the articles of headwear 66 that are stored on each of the holding units 64.

In use, the pole 26 is extended into the extended position and the plurality of cups 38 is urged into deployed position. A chosen number of the holding units 64 is attached to a respective one the cups 38, depending upon the number of articles of headwear 66 that are needing to be stored. The member 104 of each of the holding units 64 that are attached to the cups 38 are urged into deployed position if the article of headwear 66 has a brim 114. Each of the articles of headwear 66 are positioned on a respective one of the holding units 64 such that a front edge 124 of the brim, if present on the article of headwear 66, is positioned beneath the second section 110 of the grip 106. Additionally, each of the plurality of cups 38 can be rotated on the pole to facilitate a wide variety of arrangements of the articles of headwear 66.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible headwear storage assembly for storing a plurality of articles of headwear which is collapsible for storage, said assembly comprising:

a base positionable on a horizontal support surface;

a pole being coupled to and extending upwardly from said base such that said pole is vertically oriented when said base is positioned on the horizontal support surface, said pole comprising an upper half which slidably receives a lower half such that said pole has a telescopically adjustable length;

a plurality of cups, each of said plurality of cups being slidably disposed on said upper half of said pole, each of said plurality of cups having an incrementally increasing diameter between a bottom one of said plurality of cups and a top one of said plurality of cups, said plurality of cups being arrangeable into a deployed position having said plurality of cups being distributed along a substantial length of said upper half of said pole, said plurality of cups being arrangeable into a collapsed position having each of said plurality of cups being stored within said top one of said plurality of cups; and a plurality of holding units, each of said plurality of holding units being removably attachable to a respective one of said plurality of cups when said plurality of cups is positioned in said deployed position wherein each of said plurality of holding units is configured to support an article of headwear.

2. The assembly according to claim 1, wherein:

said base has a bottom side and a top side and a perimeter edge extending between said top side and said bottom side, said perimeter edge being continuously arcuate about a center of said base such that said base has a circular shape, said top side having an angled portion sloping upwardly from said perimeter edge and a planar portion being oriented parallel to said bottom side, said planar portion being centrally located having said angled portion surrounding said planar portion;

said pole has a bottom end being coupled to said top side of planar portion of said top side of said base, said bottom end being associated with said lower half, said pole having a top end being associated with said upper half; and said pole includes a lock being movably integrated into said lower half, said lock releasably engaging said upper half when said upper half is urged into an extended position for retaining said pole at a maximum length, said lock being urgeable to disengage said upper half to facilitate said upper half to be lowered onto said lower half for positioning said pole at a minimum length for storage.

3. The assembly according to claim 2, wherein:

each of said plurality of cups has an upper wall and an outer wall extending downwardly from said upper wall, said outer wall of each of said plurality of cups having a lower edge defining an opening into a respective cup;

said upper wall of each of said plurality of cups has a hole extending through said upper wall having said upper half of said pole extending through said hole in said upper wall of each of said plurality of cups; and each of said plurality of cups has a plurality of engagement holes each extending through said outer wall, said plurality of engagement holes in said outer wall being evenly spaced apart from each other and being distributed around a full circumference of said outer wall, each of said plurality of engagement holes being positioned closer to said upper wall than said lower edge of said outer wall.

4. The assembly according to claim 3, wherein:

said assembly includes a plurality of bearings, each of said plurality of bearings being attached to said interior surface of said outer wall of a respective one of said plurality of cups, each of said plurality bearings being continuously arcuate such that each of said plurality of bearings forms a closed ring thereby facilitating each of said plurality of bearings to conform to curvature of said interior surface of said outer wall;

each of said plurality of bearings engages said outer surface of said outer wall of a respective one of said plurality of cups thereby facilitating said plurality of cups to be rotatable about a respective one of said cups; and each of said plurality of bearings is aligned with said lower edge of said outer wall of said respective cup.

5. The assembly according to claim 3, wherein each of said holding units comprises:

an arm having a first end and a second end, said arm having a bend being centrally located between said first end and said second end to define a first portion of said arm forming an angle with a second portion of said arm; and a plate having a front surface being attached to said second end of said arm, said second end of said arm being insertable into a respective one of said plurality of engagement holes in said outer wall of a respective one of said cups such that said plate fills said respective engagement hole having an exterior edge of said plate conforming to a bounding edge of said respective engagement hole.

6. The assembly according to claim 5, wherein each of said plurality of holding units includes a foot being coupled to a back surface of said plate such that said foot extends upwardly beyond said plate, said foot abutting said interior surface of said outer wall of said respective cup when said second end of said arm is inserted into said respective engagement hole for retaining said second portion of said arm along a horizontal axis having said first portion of said arm extending downwardly from said second portion.

7. The assembly according to claim 5, wherein:

each of said plurality of holding units includes a panel having an upper surface and a perimeter edge which has a back side being concavely arcuate with respect to a front side of said perimeter edge of said panel such that said panel has a semicircular shape;

said panel has a slide well extending through said front side of said perimeter edge of said panel into an interior of said panel, said slide well being centrally located along said front side; and said second end of said arm is coupled to said upper surface of said panel at a point located adjacent to said back side, said second end of said arm being centrally located along said back side.

8. The assembly according to claim 7, wherein said panel is oriented to lie on a horizontal plane when said arm is secured in said respective engagement hole wherein said upper surface of said plate is configured to have the article of headwear being positioned on top of said upper surface.

9. The assembly according to claim 7, wherein each of said plurality of holding units includes:

a member being slidably inserted into said slide well in said front side of said perimeter edge of said panel; and a grip having a first section forming an angle with a second section, a forward surface of said first section being attached to an exposed end of said member such that said second section of said grip is spaced upwardly from said member and is oriented to lie on a plane being oriented parallel to said member.

10. The assembly according to claim 9, wherein:

said member is positionable in a deployed position having said grip being spaced from said front side of said perimeter edge of said panel wherein said second section of said grip is configured to have a brim of the article of headwear being positioned between said second section and said member for securing the article of headwear on said panel; and said member is positionable in a stored position having said first section lying against said front side of said perimeter edge of said panel.

11. The assembly according to claim 1, further comprising a hook having a lowermost end being coupled to and extending upwardly from a top end of said pole wherein said hook is configured to be engaged to a support for suspending said pole from the support, said hook having an uppermost end, said hook being curved between said lowermost end and said uppermost end such that said uppermost end is directed downwardly toward said lowermost end.

12. A collapsible headwear storage assembly for storing a plurality of articles of headwear which is collapsible for storage, said assembly comprising:

a base positionable on a horizontal support surface, said base having a bottom side and a top side and a perimeter edge extending between said top side and said bottom side, said perimeter edge being continuously arcuate about a center of said base such that said base has a circular shape, said top side having an angled portion sloping upwardly from said perimeter edge and a planar portion being oriented parallel to said bottom side, said planar portion being centrally located having said angled portion surrounding said planar portion;

a pole being coupled to and extending upwardly from said base such that said pole is vertically oriented when said base is positioned on the horizontal support surface, said pole comprising an upper half which slidably receives a lower half such that said pole has a telescopically adjustable length, said pole having a bottom end being coupled to said top side of planar portion of said top side of said base, said bottom end being associated with said lower half, said pole having a top end being associated with said upper half, said pole including a lock being movably integrated into said lower half, said lock releasably engaging said upper half when said upper half is urged into an extended position for retaining said pole at a maximum length, said lock being urgeable to disengage said upper half to facilitate said upper half to be lowered onto said lower half for positioning said pole at a minimum length for storage;

a plurality of cups, each of said plurality of cups being slidably disposed on said upper half of said pole, each of said plurality of cups having an incrementally increasing diameter between a bottom one of said plurality of cups and a top one of said plurality of cups, said plurality of cups being arrangeable into a deployed position having said plurality of cups being distributed along a substantial length of said upper half of said pole, said plurality of cups being arrangeable into a collapsed position having each of said plurality of cups being stored within said top one of said plurality of cups, each of said plurality of cups having an upper wall and an outer wall extending downwardly from said upper wall, said outer wall of each of said plurality of cups having a lower edge defining an opening into a respective cup, said upper wall of each of said plurality of cups having a hole extending through said upper wall having said upper half of said pole extending through said hole in said upper wall of each of said plurality of cups, each of said plurality of cups having a plurality of engagement holes each extending through said outer wall, said plurality of engagement holes in said outer wall being evenly spaced apart from each other and being distributed around a full circumference of said outer wall, each of said plurality of engagement holes being positioned closer to said upper wall than said lower edge of said outer wall;

a plurality of bearings, each of said plurality of bearings being attached to said interior surface of said outer wall of a respective one of said plurality of cups, each of said plurality bearings being continuously arcuate such that each of said plurality of bearings forms a closed ring thereby facilitating each of said plurality of bearings to conform to curvature of said interior surface of said outer wall, each of said plurality of bearings engaging said outer surface of said outer wall of a respective one of said plurality of cups thereby facilitating said plurality of cups to be rotatable about a respective one of said cups, each of said plurality of bearings being aligned with said lower edge of said outer wall of said respective cup;

a plurality of holding units, each of said plurality of holding units being removably attachable to a respective one of said plurality of cups when said plurality of cups is positioned in said deployed position wherein each of said plurality of holding units is configured to support an article of headwear, each of said holding units comprising:

an arm having a first end and a second end, said arm having a bend being centrally located between said first end and said second end to define a first portion of said arm forming an angle with a second portion of said arm;

a plate having a front surface being attached to said second end of said arm, said second end of said arm being insertable into a respective one of said plurality of engagement holes in said outer wall of a respective one of said cups such that said plate fills said respective engagement hole having an exterior edge of said plate conforming to a bounding edge of said respective engagement hole;

a foot being coupled to a back surface of said plate such that said foot extends upwardly beyond said plate, said foot abutting said interior surface of said outer wall of said respective cup when said second end of said arm is inserted into said respective engagement hole for retaining said second portion of said arm along a horizontal axis having said first portion of said arm extending downwardly from said second portion;

a panel having an upper surface and a perimeter edge which has a back side being concavely arcuate with respect to a front side of said perimeter edge of said panel such that said panel has a semicircular shape, said second end of said arm being coupled to said upper surface of said panel at a point located adjacent to said back side, said second end of said arm being centrally located along said back side, said panel being oriented to lie on a horizontal plane when said arm is secured in said respective engagement hole wherein said upper surface of said plate is configured to have the article of headwear being positioned on top of said upper surface, said panel having a slide well extending through said front side of said perimeter edge of said panel into an interior of said panel, said slide well being centrally located along said front side;

a member being slidably inserted into said slide well in said front side of said perimeter edge of said panel; and a grip having a first section forming an angle with a second section, a forward surface of said first section being attached to an exposed end of said member such that said second section of said grip is spaced upwardly from said member and is oriented to lie on a plane being oriented parallel to said member, said member being positionable in a deployed position having said grip being spaced from said front side of said perimeter edge of said panel wherein said second section of said grip is configured to have a brim of the article of headwear being positioned between said second section and said member for securing the article of headwear on said panel, said member being positionable in a stored position having said first section lying against said front side of said perimeter edge of said panel; and a hook having a lowermost end being coupled to and extending upwardly from said top end of said pole wherein said hook is configured to be engaged to a support for suspending said pole from the support, said hook having an uppermost end, said hook being curved between said lowermost end and said uppermost end such that said uppermost end is directed downwardly toward said lowermost end.

* * * * *